US009205685B2

(12) United States Patent
Nonaka et al.

(10) Patent No.: US 9,205,685 B2
(45) Date of Patent: Dec. 8, 2015

(54) IMAGE FORMING APPARATUS

(71) Applicant: Konica Minolta, Inc., Tokyo (JP)

(72) Inventors: Ken Nonaka, Tokyo (JP); Takahiro Okubo, Tokyo (JP); Yusuke Kawanago, Tokyo (JP)

(73) Assignee: KONICA MINOLTA, INC. (JP)

( * ) Notice: Subject to any disclaimer, the term of this patent is extended or adjusted under 35 U.S.C. 154(b) by 0 days.

(21) Appl. No.: 14/080,172

(22) Filed: Nov. 14, 2013

(65) Prior Publication Data

US 2014/0130694 A1 May 15, 2014

(30) Foreign Application Priority Data

Nov. 14, 2012 (JP) ..... 2012-250473

(51) Int. Cl.

| | |
|---|---|
| ***B41F 1/34*** | (2006.01) |
| ***B41J 13/26*** | (2006.01) |
| ***B41J 3/60*** | (2006.01) |
| ***B41J 11/00*** | (2006.01) |

(52) U.S. Cl.

CPC .. *B41J 13/26* (2013.01); *B41J 3/60* (2013.01); *B41J 11/0095* (2013.01)

(58) Field of Classification Search

CPC ..... B41J 13/26
USPC ..... 101/485
See application file for complete search history.

(56) References Cited

U.S. PATENT DOCUMENTS

| | | | | |
|---|---|---|---|---|
| 2003/0068181 | A1* | 4/2003 | Miyata et al. | 399/394 |
| 2005/0035536 | A1* | 2/2005 | Suga et al. | 271/226 |
| 2006/0139433 | A1* | 6/2006 | Yoshida | 347/116 |
| 2008/0253785 | A1* | 10/2008 | Yamamoto et al. | 399/68 |
| 2009/0109254 | A1* | 4/2009 | Satake et al. | 347/16 |
| 2010/0189486 | A1* | 7/2010 | Inoue | 399/395 |
| 2012/0072015 | A1* | 3/2012 | Takahashi | 700/229 |

(Continued)

FOREIGN PATENT DOCUMENTS

| | | |
|---|---|---|
| CN | 102486626 A | 6/2012 |
| CN | 102633142 A | 8/2012 |

(Continued)

OTHER PUBLICATIONS

Japanese Notice of Reasons for Rejection corresponding to Japanese Patent Application 2012-250473; Dispatch Date: Nov. 25, 2014; with English Translation.

(Continued)

*Primary Examiner* — Anthony Nguyen
(74) *Attorney, Agent, or Firm* — Cantor Colburn LLP

(57) ABSTRACT

An image forming apparatus includes a notification section that provides information to a user; a sheet feeding section that feeds a sheet; an image forming section that forms an image on a sheet; a first conveyance section that conveys a sheet fed from the sheet feeding section to the image forming section; a displacement detection section that detects a displacement of a sheet in the first conveyance section; a displacement correction section that corrects a lateral position of a sheet on the basis of a result of detection by the displacement detection section; and a control section that controls the notification section to notify an occurrence of a displacement error which cannot be corrected by the displacement correction section and a cause of the displacement error when the displacement error is detected by the displacement detection section.

7 Claims, 8 Drawing Sheets

(56) References Cited

U.S. PATENT DOCUMENTS

2012/0141179 A1* 6/2012 Atsumi ..... 399/381
2012/0248677 A1* 10/2012 Nakamura et al. ..... 271/3.18

FOREIGN PATENT DOCUMENTS

JP 2002-362781 A 12/2002
JP 2003330334 A 11/2003
JP 2005-136738 A 5/2005
JP 2011253076 A 12/2011

OTHER PUBLICATIONS

Chinese Notification of First Office Action corresponding to Application No.: 201310571641.8; Mailing Date: Sep. 30, 2015, with English translation.

* cited by examiner

A SHEET DISPLACEMENT ERROR OCCURRED
THE FOLLOWING IS POSSIBLE CAUSE:

■IMPROPER SHEET SETTING
1. CHECK SIDE REGULATION IN SHEET FEED TRAY
2. MAKE SURE SHEET IS NOT BENT

21

FIG. 7

A SHEET DISPLACEMENT ERROR OCCURRED
THE FOLLOWING IS POSSIBLE CAUSE:

■ERROR IN SHEET CONVEYANCE PATH
1. MAKE SURE FOREIGN MATERIAL
(PAPER DEBRIS, ETC.) DOES NOT EXIST IN FIRST
CONVEYANCE SECTION

21

FIG. 8

A SHEET DISPLACEMENT ERROR OCCURRED
THE FOLLOWING IS POSSIBLE CAUSE:

■ERROR IN DISPLACEMENT CORRECTION SECTION
1. CHECK REGISTRATION TRANSLATION FUNCTION
(SELF-DIAGNOSIS MODE)
2. CHECK CONTAMINATION OF BEARING
3. MAKE SURE DRIVING SECTION
(TRANSLATING MOTOR AND POWER TRANSMISSION) IS NOT BROKEN

21

FIG. 9

A SHEET DISPLACEMENT ERROR OCCURRED
THE FOLLOWING IS POSSIBLE CAUSE:

■ERROR IN SHEET CONVEYANCE PATH
1. MAKE SURE FOREIGN MATERIAL (PAPER DEBRIS, ETC.)
DOES NOT EXIST IN SECOND CONVEYANCE SECTION

21

FIG. 10

IMAGE FORMING APPARATUS

CROSS REFERENCE TO RELATED APPLICATIONS

This application is entitled to and claims the benefit of Japanese Patent Application No. 2012-250473, filed on Nov. 14, 2012, the disclosure of which including the specification, drawings and abstract is incorporated herein by reference in its entirety.

BACKGROUND OF THE INVENTION

1. Field of the Invention

The present invention relates to an electrophotographic image forming apparatus.

2. Description of Related Art

In general, an electrophotographic image forming apparatus (such as a printer, a copy machine, and a fax machine) is configured to irradiate (expose) a charged photoconductor with (to) laser light based on image data to form an electrostatic latent image on the surface of the photoconductor. The electrostatic latent image is then visualized by supplying toner from a developing device to the photoconductor (image carrier) on which the electrostatic latent image is formed, whereby a toner image is formed. Further, the toner image is directly or indirectly transferred to a sheet through an intermediate transfer belt, followed by heating and pressurization for fixing, whereby an image is formed on the sheet.

The above-described image forming apparatus includes a conveyance section for conveying to an image forming section a sheet fed from a sheet feed tray, a manual feed tray or an external paper feeding apparatus. In the sheet conveyance section, a plurality of conveyance roller sections including an intermediate conveyance roller section, a loop roller section, a registration roller section and the like are disposed, for example.

In the sheet conveyance section, a sheet is continuously conveyed by the loop roller section even after the leading edge of the sheet reaches the registration roller section, whereby the sheet is bent between the registration roller section and the loop roller section and a skew of the sheet is thus corrected.

In addition, the sheet conveyance section is provided with a displacement correction section for correcting the lateral position of sheets (horizontal scanning direction). For example, the registration roller section conveys a sheet while translating in the lateral direction (axial direction of the registration roller), thereby correcting the lateral position of the sheet (registration translation). The registration translation operation is performed based on a result of detection (displacement amount and deviation from a standard position) by a displacement detection sensor such as a line sensor disposed on a downstream side of the registration roller section.

When the displacement amount of the sheet is within the range which can be covered by the translation of the registration roller section (for example, ±5 mm), the lateral position of the sheet can be surely corrected by the registration translation. However, when the displacement amount of the sheet falls outside the range of the translation of the registration roller section, the lateral position of the sheet cannot be corrected by the registration translation, resulting in a displacement error. Under such a circumstance, in the case where a displacement error is detected by the displacement detection sensor, an image formation process is stopped by causing a jam.

In addition, there are proposed image forming apparatuses in which an image formation process is stopped when a skew of a sheet is not corrected and when a sheet (arrangement of front and back of sheets) is improperly stored in the sheet feeding section (for example, Japanese Patent Application Laid-Open Nos. 2002-362781 and 2005-136738).

The displacement error may occur in the image forming apparatus when a foreign substance such as paper debris remains in a sheet conveyance path, when the state of sheets stored in the sheet feed tray is poor due to factors such as a sheet in a folded state and an insufficient side regulation in the sheet feed tray (improper setting), and when a displacement of a sheet is reflected to an image formation on the back surface of the sheet (during the sheet conveyance) since the displacement correction section has not appropriately operated during an image formation on the front surface of the sheet (during the sheet conveyance), for example.

However, since conventional image forming apparatuses only stop the image formation process by causing a jam when a displacement error is detected, it is difficult for a user to recognize the cause of the displacement error. Therefore, the cause of the displacement error may not be eliminated when a user performs jam clearance. When the cause of the displacement error is not eliminated, a jam due to a displacement error is again caused. In this manner, the conventional handling methods are not efficient and lead to decrease in productivity.

SUMMARY OF THE INVENTION

An object of the present invention is to provide an image forming apparatus which allows a user to efficiently deal with a detected displacement error, and achieves improvement in productivity.

To achieve the abovementioned object, an image forming apparatus reflecting one aspect of the present invention includes: a notification section that provides information to a user; a sheet feeding section that feeds a sheet; an image forming section that forms an image on a sheet; a first conveyance section that conveys a sheet fed from the sheet feeding section to the image forming section; a displacement detection section that detects a displacement of a sheet in the first conveyance section; a displacement correction section that corrects a lateral position of a sheet on the basis of a result of detection by the displacement detection section; and a control section that controls the notification section to notify an occurrence of a displacement error which cannot be corrected by the displacement correction section and a cause of the displacement error when the displacement error is detected by the displacement detection section.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein:

FIG. 7 illustrates an exemplary notification screen in the case where a displacement error has occurred during an image formation on a surface of a sheet;

FIG. 8 illustrates another exemplary notification screen in the case where a displacement error has occurred during an image formation on a surface of a sheet;

FIG. 9 illustrates still another exemplary notification screen in the case where a displacement error has occurred during an image formation on a surface of a sheet; and FIG. 10 illustrates yet another exemplary notification screen in the case where a displacement error has occurred during an image formation on a surface of a sheet.

DESCRIPTION OF THE PREFERRED EMBODIMENTS

Hereinafter, embodiments of the present invention will be described in detail with reference to the accompanying drawings.

Figure 1:
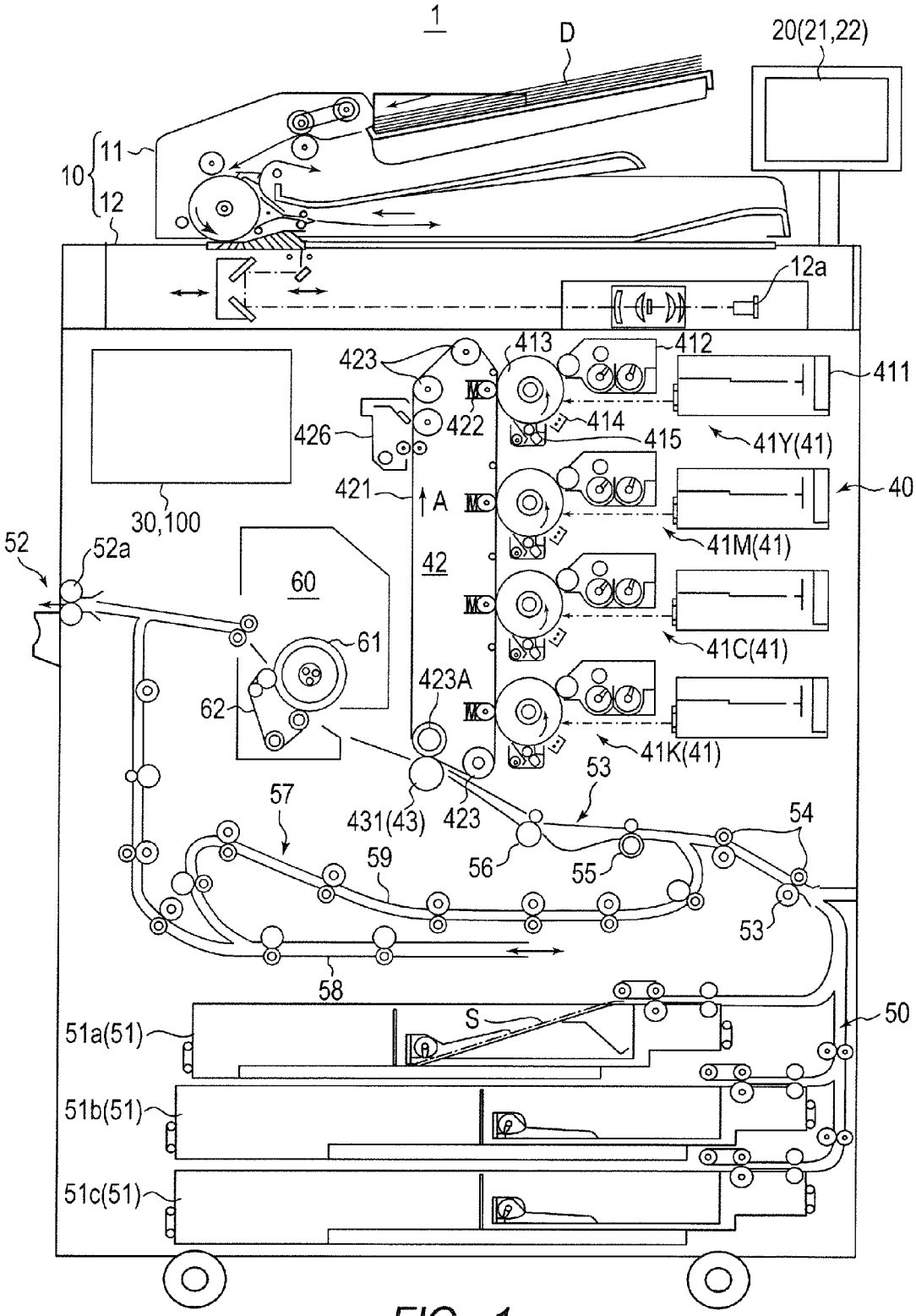
FIG. 1 schematically illustrates an overall configuration of an image forming apparatus according to an embodiment of the present invention.
Figure 2:
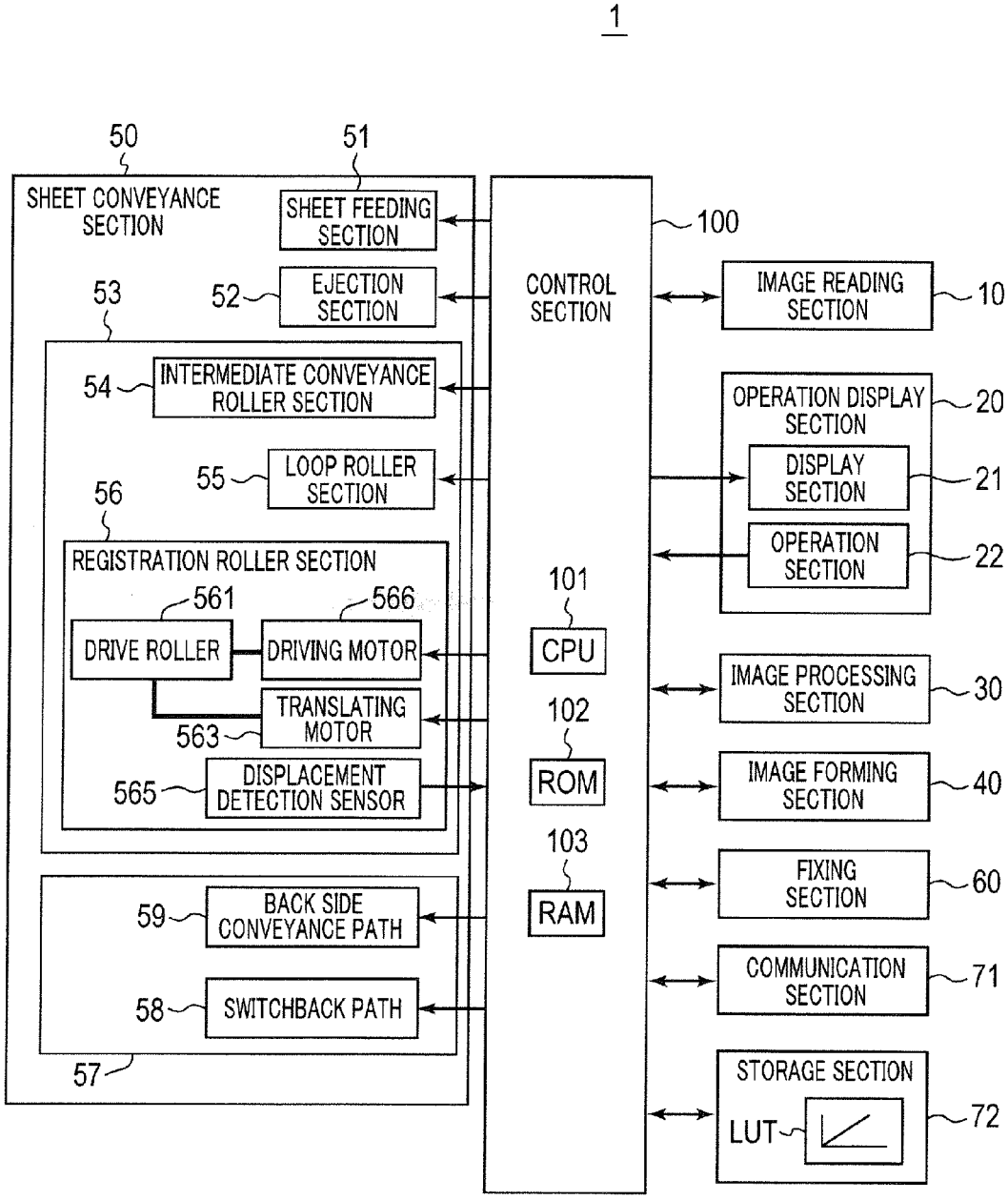
FIG. 2 illustrates a principal part of a control system of the image forming apparatus according to the embodiment.

FIG. 1 schematically illustrates an overall configuration of an image forming apparatus 1 according to an embodiment of the present invention. FIG. 2 illustrates a principal part of a control system of the image forming apparatus 1 according to the embodiment.

Image forming apparatus 1 illustrated in FIGS. 1 and 2 is a color image forming apparatus with an intermediate transfer system using electrophotographic process technology. A longitudinal tandem system is adopted for image forming apparatus 1. In the longitudinal tandem system, respective photoconductor drums 413 corresponding to the four colors of YMCK are placed in series in the travelling direction (vertical direction) of intermediate transfer belt 421, and the toner images of the four colors are sequentially transferred to intermediate transfer belt 421 in one cycle.

That is, image forming apparatus 1 transfers (primary-transfers) toner images of yellow (Y), magenta (M), cyan (C), and black (K) formed on photoconductor drums 413 to intermediate transfer belt 421, and superimposes the toner images of the four colors on one another on intermediate transfer belt 421. Then, image forming apparatus 1 transfers (secondary-transfers) the resultant image to sheet S, to thereby form an image.

As illustrated in FIGS. 1 and 2, image forming apparatus 1 includes image reading section 10, operation display section 20, image processing section 30, image forming section 40, sheet conveyance section 50, fixing section 60, and control section 100.

Control section 100 includes central processing unit (CPU) 101, read only memory (ROM) 102, random access memory (RAM) 103 and the like. CPU 101 reads a program suited to processing contents out of ROM 102, develops the program in RAM 103, and integrally controls an operation of each block of image forming apparatus 1 in cooperation with the developed program. At this time, CPU 101 refers to various kinds of data stored in storage section 72. Storage section 72 is composed of, for example, a non-volatile semiconductor memory (so-called flash memory) or a hard disk drive.

Control section 100 transmits and receives various data to and from an external apparatus (for example, a personal computer) connected to a communication network such as a local area network (LAN) or a wide area network (WAN), through communication section 71. Control section 100 receives, for example, image data transmitted from the external apparatus, and performs control to form an image on sheet S on the basis of the image data (input image data). Communication section 71 is composed of, for example, a communication control card such as a LAN card.

Image reading section 10 includes auto document feeder (ADF) 11, document image scanner (scanner) 12, and the like. Auto document feeder 11 causes a conveyance mechanism to feed document D placed on a document tray, and sends out document D to document image scanner 12. Auto document feeder 11 enables images (even both sides thereof) of a large number of documents D placed on the document tray to be successively read at once.

Document image scanner 12 optically scans a document fed from auto document feeder 11 to its contact glass or a document placed on its contact glass, and images light reflected from the document on the light receiving surface of charge coupled device (CCD) sensor 12*a*, to thereby read the document image. Image reading section 10 generates input image data on the basis of a reading result provided by document image scanner 12. Image processing section 30 performs predetermined image processing on the input image data.

Operation display section 20 includes, for example, a liquid crystal display (LCD) with a touch panel, and functions as display section 21 and operation section 22. Display section 21 displays various operation screens, image statuses, the operating conditions of each function, and the like in accordance with display control signals received from control section 100. Operation section 22 includes various operation keys such as a numeric keypad and a start key, receives various input operations performed by a user, and outputs operation signals to control section 100.

In addition, display section 21 functions as a notification section for notifying the user of the fact that a displacement error of sheets has been detected and the cause of the displacement error when the displacement error is detected during a registration translation control process described later.

Image processing section 30 includes a circuit that performs digital image processing suited to initial settings or user settings, on the input image data, and the like. For example, image processing section 30 performs toner correction on the basis of toner correction data (toner correction table), under the control of control section 100. In addition to the toner correction, image processing section 30 also performs various correction processes such as color correction and shading correction as well as a compression process, on the input image data. Image forming section 40 is controlled on the basis of the image data that has been subjected to these processes.

Image forming section 40 includes: image forming units 41 for images of colored toners respectively containing a Y component, an M component, a C component, and a K component on the basis of the input image data; intermediate transfer unit 42; and secondary transfer unit 43, and the like.

Image forming unit 41 includes image forming units 41Y, 41M, 41C, and 41K for the Y component, the M component, the C component, and the K component. Image forming units 41Y, 41M, 41C, and 41K for the Y component, the M component, the C component, and the K component have a similar configuration. For ease of illustration and description, common elements are denoted by the same reference signs. Only when elements need to be discriminated from one another, Y, M, C, or K is added to their reference signs. In FIG. 1, reference signs are given to only the elements of image forming unit 41Y for the Y component, and reference signs are omitted for the elements of other image forming units 41M, 41C, and 41K.

Image forming unit 41 includes exposure device 411, developing device 412, photoconductor drum 413, charging device 414, drum cleaning device 415 and the like.

Photoconductor drum 413 is, for example, a negatively-charged-type organic photoconductor (OPC) formed by sequentially laminating an under coat layer (UCL), a charge generation layer (CGL), and a charge transport layer (CTL) on the circumferential surface of a conductive cylindrical body (aluminum-elementary tube) made of aluminum.

The charge generation layer is made of an organic semiconductor in which a charge generating material (for example, phthalocyanine pigment) is dispersed in a resin binder (for example, polycarbonate), and generates a pair of positive charge and negative charge through exposure to light by exposure device 411. The charge transport layer is made of a layer in which a hole transport material (electron-donating nitrogen compound) is dispersed in a resin binder (for example, polycarbonate resin), and transports the positive charge generated in the charge generation layer to the surface of the charge transport layer.

Control section 100 controls a driving current supplied to a driving motor (not shown in the drawings) that rotates photoconductor drum 413, whereby photoconductor drum 413 is rotated at a constant circumferential speed.

Charging device 414 evenly negatively charges the surface of photoconductor drum 413.

Exposure device 411 is composed of, for example, a semiconductor laser, and configured to irradiate photoconductor drum 413 with laser light corresponding to the image of each color component. Because the positive charge is generated in the charge generation layer of photoconductor drum 413 and is transported to the surface of the charge transport layer, the surface charge (negative charge) of photoconductor drum 413 is neutralized. An electrostatic latent image of each color component is formed on the surface of photoconductor drum 413 due to a difference in potential from its surroundings.

Developing device 412 stores developers of respective color components (for example, two-component developers composed of toner having a small particle size and a magnetic material). Developing device 412 attaches the toners of respective color components to the surface of photoconductor drum 413, and thus visualizes the electrostatic latent image to form a toner image.

Drum cleaning device 415 includes a drum cleaning blade that is brought into sliding contact with the surface of photoconductor drum 413, and removes residual toner that remains on the surface of photoconductor drum 413 after the primary transfer.

Intermediate transfer unit 42 includes intermediate transfer belt 421, primary transfer roller 422, a plurality of support rollers 423 including backup roller 423A, and belt cleaning device 426.

Intermediate transfer belt 421 is composed of an endless belt, and is stretched around the plurality of support rollers 423 in a loop form. At least one of the plurality of support rollers 423 is composed of a driving roller, and the others are each composed of a driven roller. Support roller 423 that functions as the driving roller rotates, whereby intermediate transfer belt 421 runs at a constant speed in the arrow A direction. Intermediate transfer belt 421 is brought into pressure contact with photoconductor drums 413 by primary transfer rollers 422, whereby the toner images of the four colors are primary-transferred to intermediate transfer belt 421 so as to be sequentially superimposed on each other.

Secondary transfer unit 43 is composed of secondary transfer roller 431, for example. Secondary transfer unit 43 may have a configuration in which a secondary transfer belt is installed in a stretched state around a plurality of support rollers including the secondary transfer roller in a loop form.

Secondary transfer roller 431A is brought into pressure contact with backup roller 423A with intermediate transfer belt 421 therebetween, whereby a transfer nip (transfer section) is formed. When sheet S passes through the transfer nip, the toner images carried on intermediate transfer belt 421 are secondary-transferred to sheet S. Specifically, a voltage (transfer bias) having a polarity opposite to that of the toner is applied to secondary transfer roller 431, whereby the toner images are electrostatically transferred to sheet S. Sheet S on which the toner images have been transferred is conveyed toward fixing section 60.

Belt cleaning device 426 includes a belt cleaning blade that is brought into sliding contact with the surface of intermediate transfer belt 421, and removes residual toner that remains on the surface of intermediate transfer belt 421 after secondary transfer.

Fixing section 60 includes fixing side member 61 (for example, fixing belt) disposed on the fixing surface (the surface on which a toner image has been formed) side of sheet S, and back side supporting member 62 (for example, pressure roller) disposed on the back side (the surface opposite the fixing surface) of sheet S. Back side supporting member 62 is brought into pressure contact with fixing side member 61, thus forming a fixing nip for conveying sheet S in a tightly sandwiching manner. Fixing section 60 heats and pressurizes sheet S conveyed thereto at its fixing nip, to thereby fix the toner images to sheet S. Fixing section 60 may include an air separation unit that blows air to thereby separate sheet S from fixing side member 61 (for example, a fixing belt) or back side supporting member 62 (for example, a pressure roller).

Sheet conveyance section 50 includes sheet feeding section 51, ejection section 52, first conveyance section 53, second conveyance section 57 and the like.

Three sheet feed tray units 51*a* to 51*c* included in sheet feeding section 51 store sheets S (standard sheets, special sheets) discriminated on the basis of the basis weight, the size, and the like, for each type set in advance.

First conveyance section 53 includes a plurality of conveyance roller sections including intermediate conveyance roller section 54, loop roller section 55, and registration roller section 56.

Loop roller section 55 conveys sheet S passed from intermediate conveyance roller section 54 on the upstream side and passes the sheet to registration roller section 56 on the downstream side. Loop roller section 55 bends the sheet in a loop forming section between loop roller section 55 and registration roller section 56.

Registration roller section 56 is disposed on the downstream side of loop roller section 55, and corrects a skew and the lateral (horizontal scanning direction) position of sheet S. That is, in the present embodiment, registration roller section 56 functions as a displacement correction section.

Figure 3:
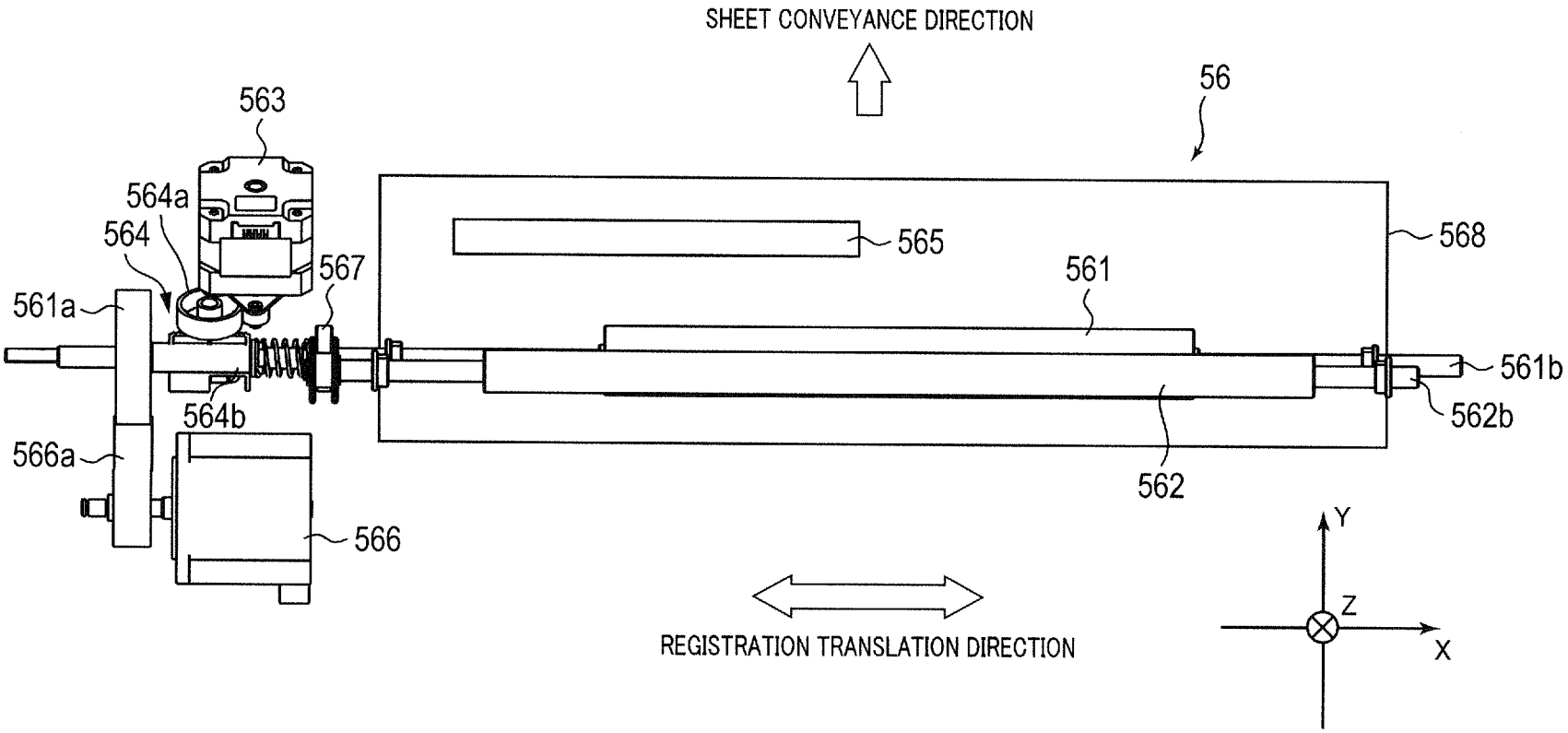
FIG. 3 illustrates a registration roller section as viewed from above.
Figure 4:
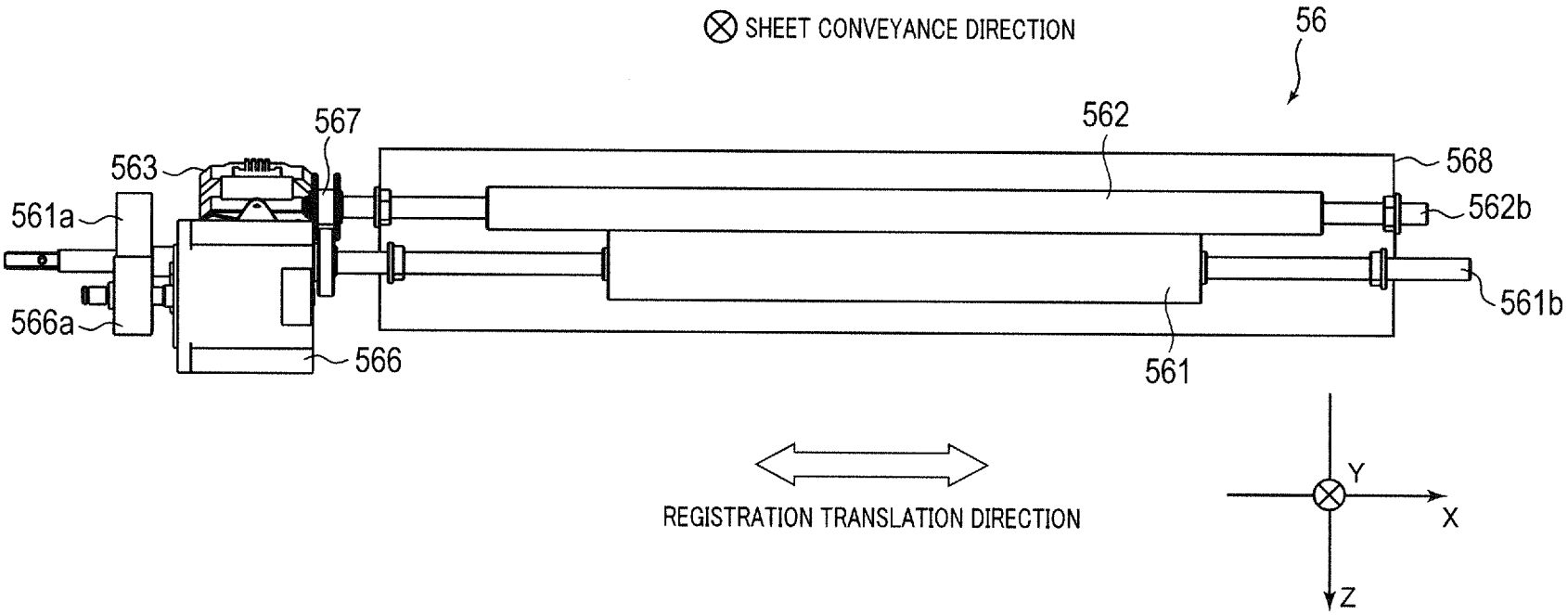
FIG. 4 illustrates a registration roller section as viewed from an upstream side in a sheet conveyance direction.

FIG. 3 illustrates registration roller section 56 as viewed from above (from the proximal side in a Z direction). FIG. 4 illustrates registration roller section 56 as viewed from the upstream side in the sheet conveyance direction (from the proximal side in a Y direction). In FIGS. 3 and 4, the X axis corresponds to the horizontal direction (the axial direction of the registration roller), the Z axis to the vertical direction, and the Y axis to the sheet conveyance direction orthogonal to the X axis and Z axis.

As illustrated in FIGS. 3 and 4, registration roller section 56 has drive roller 561 and driven roller 562 disposed in facing relation to drive roller 561. For example, drive roller 561 is composed of a rubber roller and driven roller 562 is composed of a metal roller. Driven roller 562 is kept in a state where it is in pressure contact with drive roller 561 at all times. Driven roller 562 pressure contacts with drive roller 561, thus forming a nip portion (registration nip) for conveying sheet S in a tightly sandwiching manner.

Drive roller 561 and driven roller 562 are each inserted in a bearing formed in frame 568 and thus rotatably fixed. By translating frame 568 in a vertical direction or a horizontal direction in a state where drive roller 561 and driven roller 562 are fixed, the axial direction can be adjusted while maintaining the positional relationship of drive roller 561 and driven roller 562.

In addition, roller shafts 561*b* and 562*b* are coupled by coupling member 567. Thus, when correcting the lateral position of sheet S, drive roller 561 and driven roller 562 are move together in the lateral direction.

Drive roller 561 is connected to driving motor 566 via a power transmission section including gears 561*a* and 566*a*. Gear 561*a* has a predetermined length so as to allow transmission of a driving forth even when drive roller 561 moves in the axial direction during the registration translation. When the driving forth of driving motor 566 is transmitted to drive roller 561 via gears 566*a* and 561*a*, drive roller 561 and driven roller 562 are rotated. A sheet conveyance operation (driving of driving motor 566) in registration roller section 56 is controlled by control section 100.

In addition, drive roller 561 is connected to translating motor 563 via power transmission 564 composed of rack 564*b* and pinion 564*a*. Rack 564*b* is a cylindrical member having a bearing therein, and roller shaft 561*b* is inserted to rack 564*b*. Both ends of rack 564*b* are sandwiched with two washers (for example, E-shaped rings) fixed to roller shaft 561*b*, whereby rack 564*b* is fixed in the vicinity of gear 561*a*. That is, rack 564*b* is fixed so as not to move in the axial direction while allowing the rotation of drive roller 561.

On the downstream side of registration roller section 56, displacement detection sensor 565 that detects the displacement of sheet S is disposed. To be more specific, displacement detection sensor 565 is disposed in parallel with drive roller 561 and driven roller 562 in a region on the downstream side of the registration nip in frame 568.

Displacement detection sensor 565 is composed of a line sensor in which, for example, image receiving devices are arranged side by side in a single horizontal row (or in a plurality of horizontal rows), and is configured to detect the lateral position of an end portion of sheet S. When displacement detection sensor 565 is composed of a line sensor, the displacement amount (deviation from a standard position) of sheet S can be detected with a high accuracy (for example, in a unit of several tens of micrometers).

Control section 100 controls the registration translation operation in registration roller section 56 (registration translation control process). To be more specific, control section 100 controls translating motor 563 on the basis of a result of detection by displacement detection sensor 565. The rotational movement of translating motor 563 is converted into a linear movement by pinion 564*a* and rack 564*b*, and then transmitted to drive roller 561. Thus, drive roller 561 and driven roller 562 move in the axial direction by a predetermined amount.

Figure 5A:
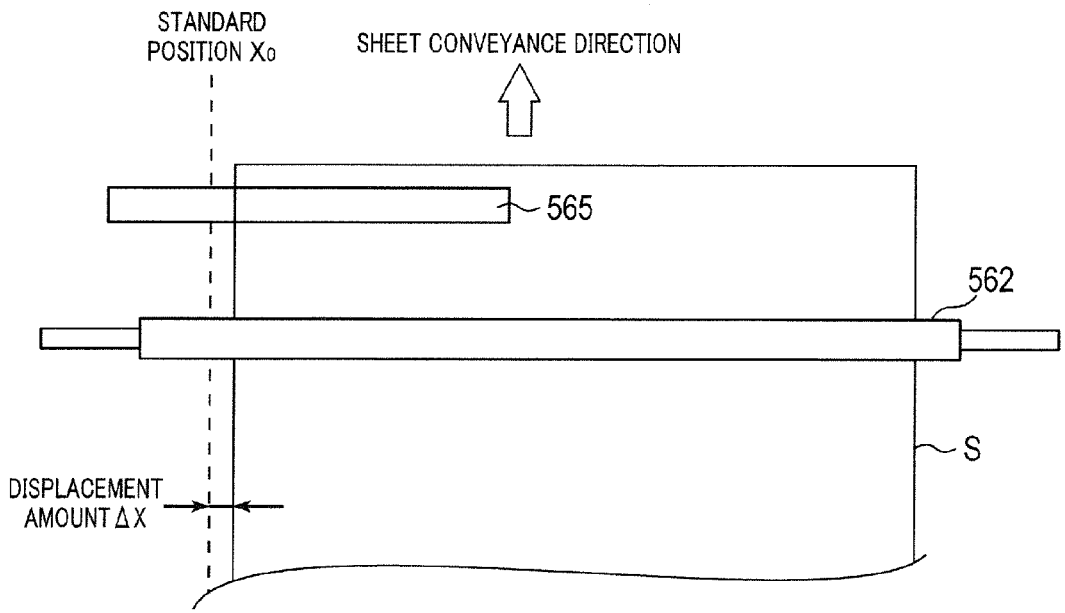
FIG. 5A illustrates an exemplary registration translation operation.
Figure 5B:
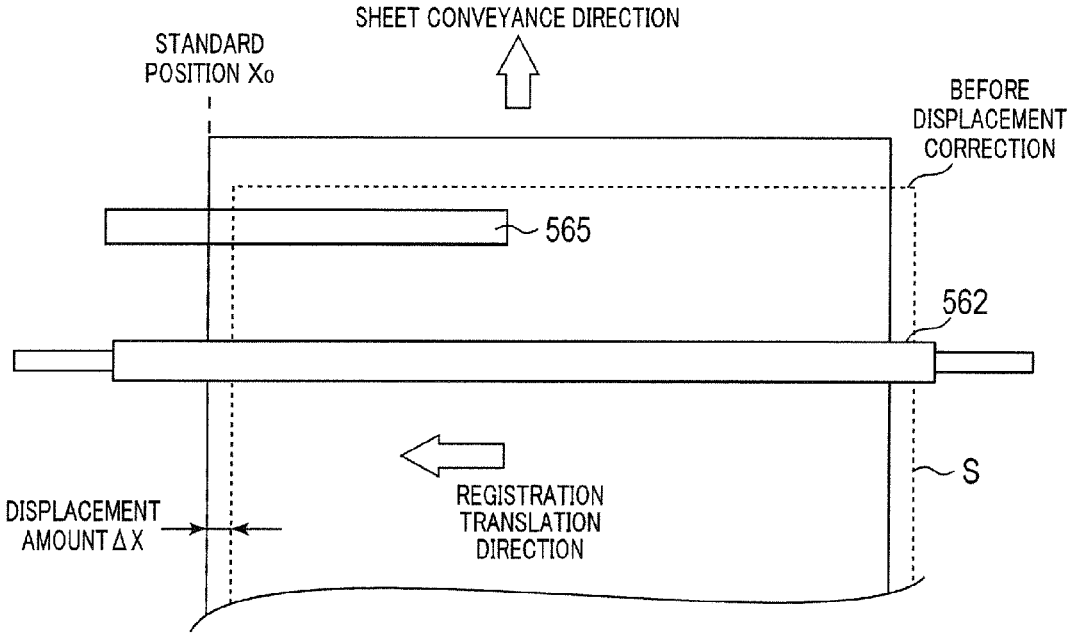
FIG. 5B illustrates an exemplary registration translation operation.

For example, in the case where sheet S is displaced rightward in the lateral direction as illustrated in FIG. 5A, control section 100 computes a displacement amount ΔX (deviation from a standard position X0) on the basis of a result of detection by displacement detection sensor 565 (the lateral position of the left end portion). Then, control section 100 moves registration roller section 56 in a direction toward the standard position X0 of the left end portion of sheet S in the lateral direction (in FIG. 5, toward left direction) by the displacement amount ΔX. Drive roller 561 and driven roller 562 move by the displacement amount ΔX while they are rotating, i.e., conveying sheet S, whereby the lateral position of sheet S is corrected (see FIG. 5B).

It is to be noted that when the result of the detection by displacement detection sensor 565 is greater than the range of the translation of registration roller section 56 (for example, ±5 mm), the lateral position of sheet S cannot be corrected completely, and therefore a jam is caused and the image formation process is stopped.

Second conveyance section 57 includes back side conveyance path 59 and switchback path 58 in which a plurality of conveyance roller sections are disposed. Second conveyance section 57 once conveys sheet S to switchback path 58, and then performs a switchback to convey sheet S to back side conveyance path 59, thus inverting sheet S. Thereafter, second conveyance section 57 feeds sheet S to first conveyance section 53 (the upstream of loop roller section 55).

Sheet S fed from sheet feed tray units 51*a* to 51*c* or an external sheet feeding apparatus (not illustrated) is conveyed to image forming section 40 by first conveyance section 53. At this time, even after the leading edge of sheet S has reached registration roller section 56, conveyance of sheets by loop roller section 55 is continued with the rotational driving of registration roller section 56 (drive roller 561) being stopped. Thus, a state where the leading edge of sheet S is striking the registration nip is established, causing deflection of sheet S in the loop forming section. As a result, a skew of sheet S is corrected by the stress exerted on sheet S.

After the skew of sheet S is corrected, the sheet conveyance by registration roller section 56 (rotational driving of drive roller 561) is started and sheet S is conveyed toward the transfer nip of image forming section 40. At this time, when a displacement of sheet S is detected by displacement detection sensor 565, the lateral position of sheet S is corrected in the process of conveyance by registration roller section 56 (registration translation).

Thereafter, a toner image on intermediate transfer belt 421 is secondary-transferred to one side (front surface) of sheet S at one time at the time when sheet S passes through the transfer nip, and then a fixing process is performed in fixing section 60. Sheet S on which an image has been formed is ejected out of the image forming apparatus by ejection section 52 including sheet discharging roller 52*a*.

When forming an image on both sides of sheet S, the sheet sent out from fixing section 60 is conveyed to second conveyance section 57. Sheet S is inverted by second conveyance section 57, and then conveyed to first conveyance section 53. A toner image on intermediate transfer belt 421 is secondary-transferred to the other side (back surface) of sheet S at one time at the time when sheet S passes through the transfer nip, and then the fixing process is performed in fixing section 60. Sheet S formed with images on both sides thereof is ejected out of the image forming apparatus by ejection section 52.

Figure 6:
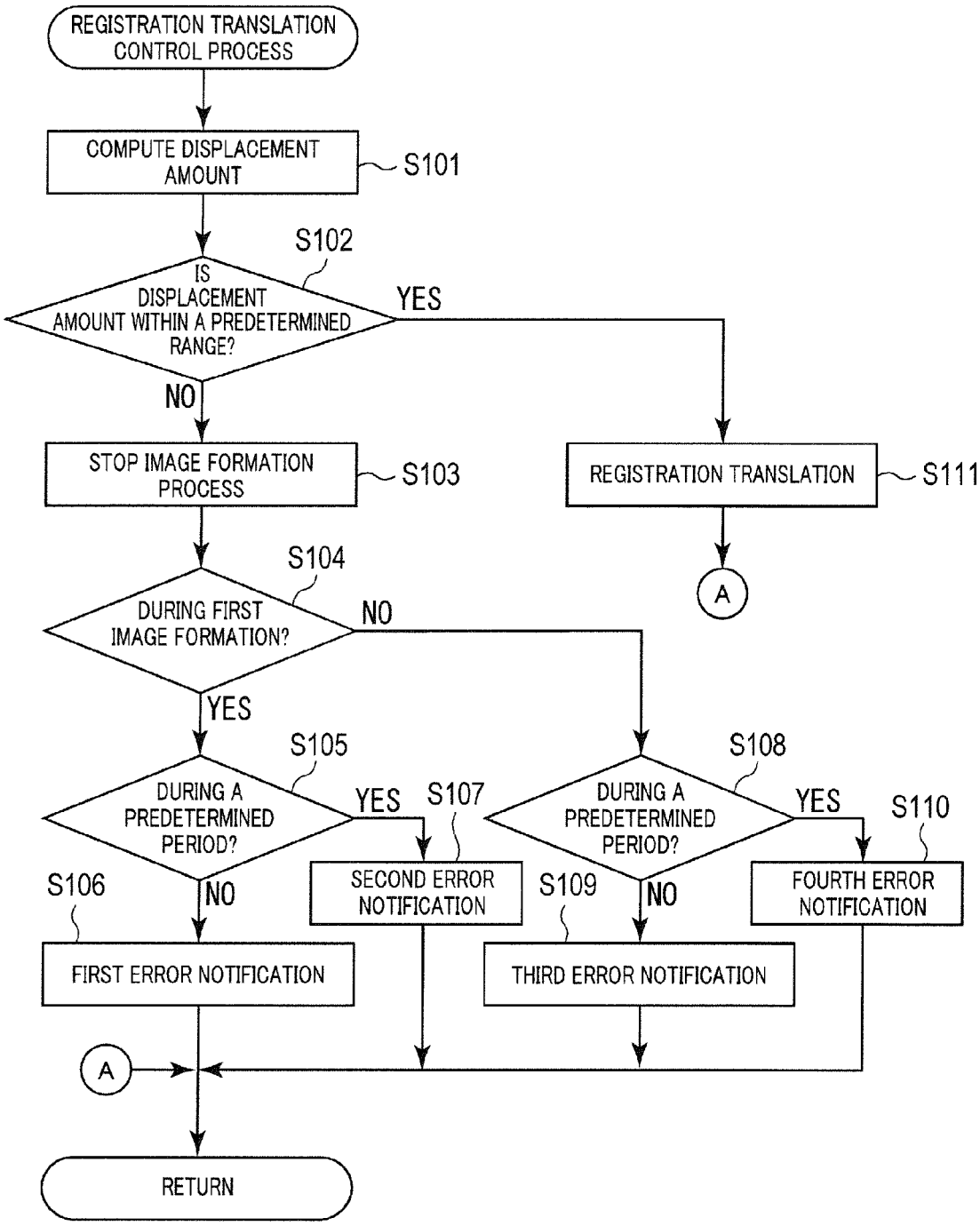
FIG. 6 is a flowchart illustrating an exemplary registration translation control process.

FIG. 6 is a flowchart illustrating an exemplary registration translation control process. The registration translation control process illustrated in FIG. 6 is achieved in such a manner that CPU 101 executes a predetermined program stored in ROM 102 with the start of an image formation process, for example.

At step S101 of FIG. 6, control section 100 computes a displacement amount of sheet S on the basis of a result of detection by displacement detection sensor 565 (the lateral position of the left end portion of sheet S).

At step S102, control section 100 determines whether or not the displacement amount of sheet S is within a predetermined range. The predetermined range is a range within which the displacement can be corrected by the registration translation, and in this instance, a range which can be covered by the translation of registration roller section 56 (for example ±5 mm).

When control section 100 determines that the displacement amount of sheet S is within the predetermined range, the process is advanced to step S111 to carry out a normal registration translation operation. The registration translation operation is not carried out when no displacement of sheet S has been found, as a matter of course.

On the other hand, when control section 100 determines that the displacement amount of the sheet falls outside the predetermined range, in other words, in the case of a displacement error in which the lateral position of sheet S cannot be corrected by the registration translation, the process is advanced to step S103.

At step S103, control section 100 forcibly stops all image formation processes including the sheet conveyance since if the image formation processes are continued at this time, a jam may occur, or image quality may be significantly decreased.

At step S104, control section 100 determines whether or not the present displacement error has occurred during a first image formation during which an image is formed on the front surface of sheet S. When control section 100 determines that the present displacement error has occurred during the first image formation, the process is advanced to step S105. On the other hand, when control section 100 determines that the present displacement error has occurred not during the first image formation, in other words, when control section 100 determines that the present displacement error has occurred during a second image formation during which an image is formed on the back surface of sheet S, the process is advanced to step S108.

At step S105, control section 100 determines whether or not the present displacement error has occurred during a predetermined period. When control section 100 determines that the present displacement error has occurred during the predetermined period, the process is advanced to step S107, whereas when control section 100 determines that the present displacement error has occurred not during the predetermined period, the process is advanced to step S106.

It suffices that the predetermined period is a criterion for determining that the displacement error has again occurred, in other words, determining that the cause of the displacement error has not eliminated. For example, the predetermined period may be a predetermined time starting from resumption of an image formation process having been stopped due to a displacement error, or a period required for image formation processes for a certain number of sheets performed after the resumption. When the present displacement error has occurred during the predetermined period, it can be said that the measure taken for the last displacement error is improper and the cause of the displacement error is not eliminated.

At step S106, control section 100 controls display section 21 to display a first error notification containing information about occurrence of a displacement error and the cause of the displacement error. The first error notification notifies the user of the fact that there is a problem with the state of sheets stored in sheet feeding section 51 (improper setting), as the cause of the displacement error (see FIG. 7). The first error notification also includes a notification that advises the user to check side regulation of the sheet feed tray, a notification that advises the user to make sure that sheets to be fed are not bent, and the like. The user can thus readily recognize measures for eliminating the displacement error as well as the cause of the displacement error.

Examples of the possible cause of the displacement error caused during the first image formation on the front surface of a sheet include an improper sheet setting and a foreign material such as paper debris remaining in first conveyance section 53. Considering the fact that the state of first conveyance section 53 has been checked at an adjusting step, it is highly possible that the cause is the improper sheet setting. Accordingly, when a displacement error has suddenly occurred during the first image formation, the fact that there may be a problem with the state of sheets stored in sheet feeding section 51 is preferentially notified as the cause of the displacement error.

When it is determined that the present displacement error has occurred during the predetermined period ("YES" at step S105), control section 100 controls display section 21 to display a second error notification containing information about occurrence of a displacement error and the cause of the displacement error at step S107. The second error notification notifies the user of the fact that first conveyance section 53 has a problem as the cause of the displacement error (see FIG. 8). In addition, the second error notification includes a notification that advises the user to make sure that a foreign material such as paper debris does not exist in first conveyance section 53, and the like. The user can thus readily recognize measures for eliminating the displacement error as well as the cause of the displacement error.

When a displacement error has again occurred during the first image formation, it is highly possible that first conveyance section 53 has a problem since it is considered that the improper sheet setting has been checked at the time of the last displacement error. Accordingly, the fact that first conveyance section 53 may have a problem is notified as the cause of the displacement error.

When it is determined that the present displacement error has occurred during the second image formation on the back surface of a sheet ("NO" of step S104), control section 100 determines whether or not the present displacement error has occurred in the predetermined period. When control section 100 determines that the present displacement error has occurred in the predetermined period, the process is advanced to step S110, whereas when control section 100 determines that the present displacement error has occurred not during the predetermined period, the process is advanced to step S110. The process of step S108 is the same as that of step S105.

At step S109, control section 100 controls display section 21 to display a third error notification containing information about occurrence of a displacement error and the cause of the displacement error. The third error notification notifies the user of the fact that registration roller section 56 serving as a displacement correction section has a problem as the cause of the displacement error (see FIG. 9). In addition, the third error notification includes a notification that advises the user to check the registration translation function, a notification that advises the user to check contamination of the bearings of drive roller 561 and driven roller 562, a notification that advises the user to make sure that the driving section for the registration translation (translating motor 563 and power transmission 564) is not broken, and the like. The user can thus readily recognize measures for eliminating the displacement error as well as the cause of the displacement error.

The displacement error may be caused during the second image formation on the back surface of a sheet when, for example, the lateral position of the sheet has not properly corrected during the first image formation since registration roller section 56 serving as the displacement correction section has a problem, or when a foreign material such as paper debris remains in second conveyance section 57. Considering the fact that the state of second conveyance section 57 has been checked at an adjusting step, it is highly possible that registration roller section 56 has a problem. Accordingly, when a displacement error has suddenly occurred during the second image formation, the fact that registration roller section 56 serving as the displacement correction section may have a problem is preferentially notified as the cause of the displacement error.

When it is determined that the present displacement error has occurred during the predetermined period ("YES" at step S108), control section 100 controls display section 21 to display a fourth error notification containing information about occurrence of a displacement error and the cause of the displacement error at step S110. The fourth error notification notifies the user of the fact that second conveyance section 57 has a problem as the cause of the displacement error (see FIG. 10). In addition, the fourth error notification includes a notification that advises the user to make sure that a foreign material such as paper debris does not exist in first conveyance section 57, and the like. The user thus can readily recognize measures for eliminating the displacement error as well as the cause of the displacement error.

When a displacement error has again occurred during the second image formation, it is highly possible that second conveyance section 57 has a problem since it is considered that registration roller section 56 has been checked at the time of the last displacement error. Accordingly, the fact that second conveyance section 57 may have a problem is notified as the cause of the displacement error.

After the first to fourth error notifications are issued, the translation control process is executed as the user performs a resumption operation of the image formation process. In addition, after the registration translation operation is performed at step S111, the same registration translation control process is performed in an image formation on the next sheet (which includes an image formation on the back surface of the same sheet).

As described above, image forming apparatus 1 includes display section 21 (notification section) that provides information to a user, sheet feeding section 51 that feeds sheets, image forming section 40 that forms images on sheets S, first conveyance section 53 that conveys sheet S fed from sheet feeding section 51 to image forming section 40, displacement detection sensor 565 (displacement detection section) that detects a displacement of sheet S in first conveyance section 53, registration roller section 56 (displacement correction section) that corrects the lateral position of sheet S on the basis of a result of detection by displacement detection sensor 565, and control section 100 that notifies on display section 21 the fact that a displacement error has occurred and the cause of the displacement error when a displacement error which cannot be corrected by registration roller section 56 is detected by displacement detection sensor 565.

With image forming apparatus 1, a user can readily recognize not only the occurrence of a displacement error of sheet S, but also the cause of the displacement error, and therefore the user can efficiently deal with the error. Consequently, improvement in productivity can be achieved.

In addition, circumstances under which the displacement error has occurred, specifically, whether the displacement error has occurred during the first image formation on the front surface of sheet S or the second image formation on the back surface of sheet S, and whether the error has occurred suddenly or repeatedly, are taken into account in order to appropriately estimate the cause of the displacement error, which is provided to the user. Thus the user can deal with the error more efficiently.

While the invention made by the present inventor has been specifically described based on the preferred embodiments, it is not intended to limit the present invention to the above-mentioned preferred embodiments but the present invention may be further modified within the scope and spirit of the invention defined by the appended claims.

While image forming apparatus 1 including first conveyance section 53 and second conveyance section 57 has been described in the embodiment, the present invention may be applied to an image forming apparatus having only the first conveyance section that cannot perform duplex printing.

In addition, the displacement correction section that corrects the lateral position of a sheet may be composed of other conveyance roller sections than registration roller section 56.

In addition, the information relating to occurrence of a displacement error may be notified not only by the display on display section 21, but also by sound or the combination of the display and the sound.

The embodiment disclosed herein is merely an exemplification and should not be considered as limitative. The scope of the present invention is specified by the following claims, not by the above-mentioned description. It should be understood that various modifications, combinations, sub-combinations and alterations may occur depending on design requirements and other factors in so far as they are within the scope of the appended claims or the equivalents thereof.

What is claimed is:

1. An image forming apparatus comprising:

a notification section that provides information to a user;

a sheet feeding section that feeds a sheet;

an image forming section that forms an image on a sheet;

a first conveyance section that conveys a sheet fed from the sheet feeding section to the image forming section;

a displacement detection section that detects a displacement of a sheet in the first conveyance section;

a displacement correction section that corrects a lateral position of a sheet on the basis of a result of detection by the displacement detection section; and a control section that controls the notification section to notify an occurrence of a displacement error which cannot be corrected by the displacement correction section and a cause of the displacement error on the basis of a predetermined time starting from resumption of an image formation process having been stopped due to a displacement error when the displacement error is detected by the displacement detection section, the predetermined time being a criterion for determining that the displacement error has not been eliminated.

2. The image forming apparatus according to claim 1, wherein when the displacement detection section detects a displacement error during a first image formation during which an image is formed on a front surface of the sheet, the control section controls the notification section to notify a fact that there is a problem with a state of a sheet stored in the sheet feeding section as a cause of the displacement error.

3. The image forming apparatus according to claim 2, wherein when the displacement detection section again detects a displacement error during the first image formation in a predetermined period, the control section controls the notification section to notify a fact that the first conveyance section has a problem as a cause of the displacement error.

4. The image forming apparatus according to claim 1 further comprising a second conveyance section that inverts a sheet having a front surface on which an image is formed by the image forming section, the second conveyance section conveying the sheet to the first conveyance section, wherein when the displacement detection section detects a displacement error during a second image formation during which an image is formed on a back surface of the sheet, the control section controls the notification section to notify a fact that the displacement correction section has a problem as a cause of the displacement error.

5. The image forming apparatus according to claim 4, wherein when the displacement detection section again detects a displacement error during the second image formation in a predetermined period, the control section controls the notification section to notify a fact that the second conveyance section has a problem as a cause of the displacement error.

6. The image forming apparatus according to claim 1, wherein the displacement detection section is composed of a line sensor that detects a lateral position of an end portion of the sheet.

7. The image forming apparatus according to claim 1, wherein the displacement correction section is disposed on an upstream side of a transfer section of the image forming section, and is composed of a registration roller section movable in a lateral direction of the sheet.

* * * * *